US007309069B2

(12) United States Patent
Murphy

(10) Patent No.: US 7,309,069 B2
(45) Date of Patent: Dec. 18, 2007

(54) ROLLER ASSEMBLY FOR AN IN-LINE ROLLER SKATE

(75) Inventor: Stephen Murphy, Montreal (CA)

(73) Assignee: Sport Maska Inc., Westmount, Quebec (CA)

( * ) Notice: Subject to any disclaimer, the term of this patent is extended or adjusted under 35 U.S.C. 154(b) by 0 days.

(21) Appl. No.: 10/945,202

(22) Filed: Sep. 20, 2004

(65) Prior Publication Data

US 2005/0093255 A1 May 5, 2005

(30) Foreign Application Priority Data

Sep. 19, 2003 (CA) ..... 2441754

(51) Int. Cl.
*A63C 17/06* (2006.01)

(52) U.S. Cl. ..... 280/11.222; 280/11.19; 280/11.221; 280/11.223; 280/11.231

(58) Field of Classification Search ..... 280/11.221–23, 280/11.227, 11.231–2, 11.19, 841
See application file for complete search history.

(56) References Cited

U.S. PATENT DOCUMENTS

| | | | | | |
|---|---|---|---|---|---|
| 33,689 | A * | 11/1861 | Anderson | ..... | 280/11.222 |
| 253,784 | A * | 2/1882 | Tapper | ..... | 280/11.222 |
| 1,260,692 | A * | 3/1918 | Madsen | ..... | 280/11.222 |
| 1,694,374 | A * | 12/1928 | Colwell | ..... | 280/11.232 |
| 1,988,055 | A * | 1/1935 | Stein | ..... | 280/11.222 |
| 2,145,219 | A * | 1/1939 | Burton | ..... | 280/11.222 |
| 5,348,321 | A * | 9/1994 | Sbrilli | ..... | 280/11.222 |
| 5,429,543 | A * | 7/1995 | Tilbor et al. | ..... | 446/456 |
| 5,437,466 | A | 8/1995 | Meibock et al. | | |
| 5,738,360 | A * | 4/1998 | Petell et al. | ..... | 280/11.232 |
| 6,012,726 | A | 1/2000 | Grande et al. | | |
| 6,112,434 | A | 9/2000 | Seltzer et al. | | |
| 6,142,490 | A | 11/2000 | Monroy et al. | | |
| 6,276,696 | B1 * | 8/2001 | Wong | ..... | 280/11.222 |
| 6,290,242 | B1 | 9/2001 | Ludwig | | |
| 6,485,034 | B1 | 11/2002 | Chou | | |
| 6,874,794 | B2 * | 4/2005 | Holland | ..... | 280/11.206 |
| 2001/0022434 | A1 | 9/2001 | Sauter et al. | | |
| 2002/0184795 | A1 | 12/2002 | Kan | | |

* cited by examiner

*Primary Examiner*—Christopher P. Ellis
*Assistant Examiner*—Vaughn T. Coolman
(74) *Attorney, Agent, or Firm*—Seyfarth Shaw LLP

(57) ABSTRACT

The present invention discloses a roller assembly of an in-line roller skate, the roller assembly comprising a roller frame and a plurality of roller wheels, of at least two different sizes, which are fastened pivotally with the roller frame, such that the roller assembly may rock forwards and backwards upon a surface.

3 Claims, 2 Drawing Sheets

ROLLER ASSEMBLY FOR AN IN-LINE ROLLER SKATE

CROSS-REFERENCE TO RELATED APPLICATIONS

The present application claims the benefits of Canadian patent application No. 2,441,754 filed Sep. 19, 2003, which is hereby incorporated by reference.

TECHNICAL FIELD

The invention relates to a roller assembly for an in-line roller skate.

BACKGROUND

Many roller assemblies for in-line roller skates have been introduced to this day. Typically, the roller assemblies have in common a plurality of equal size weight bearing roller wheels fastened pivotally with a roller frame such that the roller wheels are arranged linearly and glide in the same plane upon a surface. The roller frame is generally fabricated using an extrusion process, the material being a metal, such as steel or aluminum, or a composite material. The extrusion is machined so as to create two side walls that extend lengthwise of the frame and that are spaced apart transversely of the frame. The side walls are bridged by mounting brackets that are spaced lengthwise of the frame to provide for mounting of the frame to the heel and sole regions of a skating boot or shoe. It is further known to provide a transverse slot in one of these mounting brackets so that a fastening means which is used to fasten the roller frame to the boot or shoe may pass through and provide a limited degree of transverse adjustment of the roller frame on the boot or shoe at that mounting bracket. It is also known to mount the roller wheels, typically made of polyurethane, between the side walls of the frame by means of axles that fit in aligned through-holes in the side walls.

Maneuverability and stability are two important characteristics of in-line roller skates. The longer the roller wheel base of the roller assembly (e.g. the distance from front to rear roller wheels), the more stable the roller skate is but the less maneuverable it becomes. Conversely, the shorter the roller wheel base of the roller assembly, the more maneuverable the roller skate is but the less stable it becomes. The stability is due to the fact that the longer the roller wheel base is, the farther the roller wheels extend beyond the toes and heel of the skating boot or shoe having for effect to stop the user from tumbling forwards or backwards when the weight of the user is biased forward or backward, respectively. On the other hand, the longer roller wheel base hinders maneuverability by increasing the turning radius of the in-line roller skate. Conversely, the maneuverability is due to the fact that the shorter the roller wheel base is, the smaller the in-line roller skate's turning radius is. On the other hand, the shorter roller wheel base makes it easier for the user to tumble forwards or backwards when his weight is biased forward or backward, respectively.

Thus, an increase in either of the two characteristics entails a reduction in the other characteristic.

SUMMARY

According to one aspect of the present invention, there is provided a roller assembly of an in-line roller skate, the roller assembly comprising:

a roller frame; and a plurality of roller wheels fastened pivotally with the roller frame such that the roller wheels are arranged linearly, and that the roller wheels glide in the same plane upon a surface;

wherein the roller wheels are of a least two different sizes.

According to another aspect of the present invention, there is further provided a roller assembly of an in-line roller skate, the roller assembly comprising:

a roller frame;

a front roller wheel, at least two middle roller wheels and a rear roller wheel fastened pivotally with the roller frame such that the front, middle and rear roller wheels are arranged linearly, and that the front, middle and rear roller wheels glide in the same plane upon a surface;

the front roller wheel being of a first size;

the at least two middle roller wheels being of a second size that is greater than the first size;

the rear roller wheel being of a third size that is greater than the second size;

wherein at rest the front roller wheel is not in contact with the surface and the rear roller wheel is fastened pivotally with the roller frame at a distance from the surface that is greater than for the front and middle roller wheels.

BRIEF DESCRIPTION OF THE FIGURES

An embodiment of the invention will now be described by way of example only with reference to the accompanying drawings, in which.

DETAILED DESCRIPTION

Figure 1:
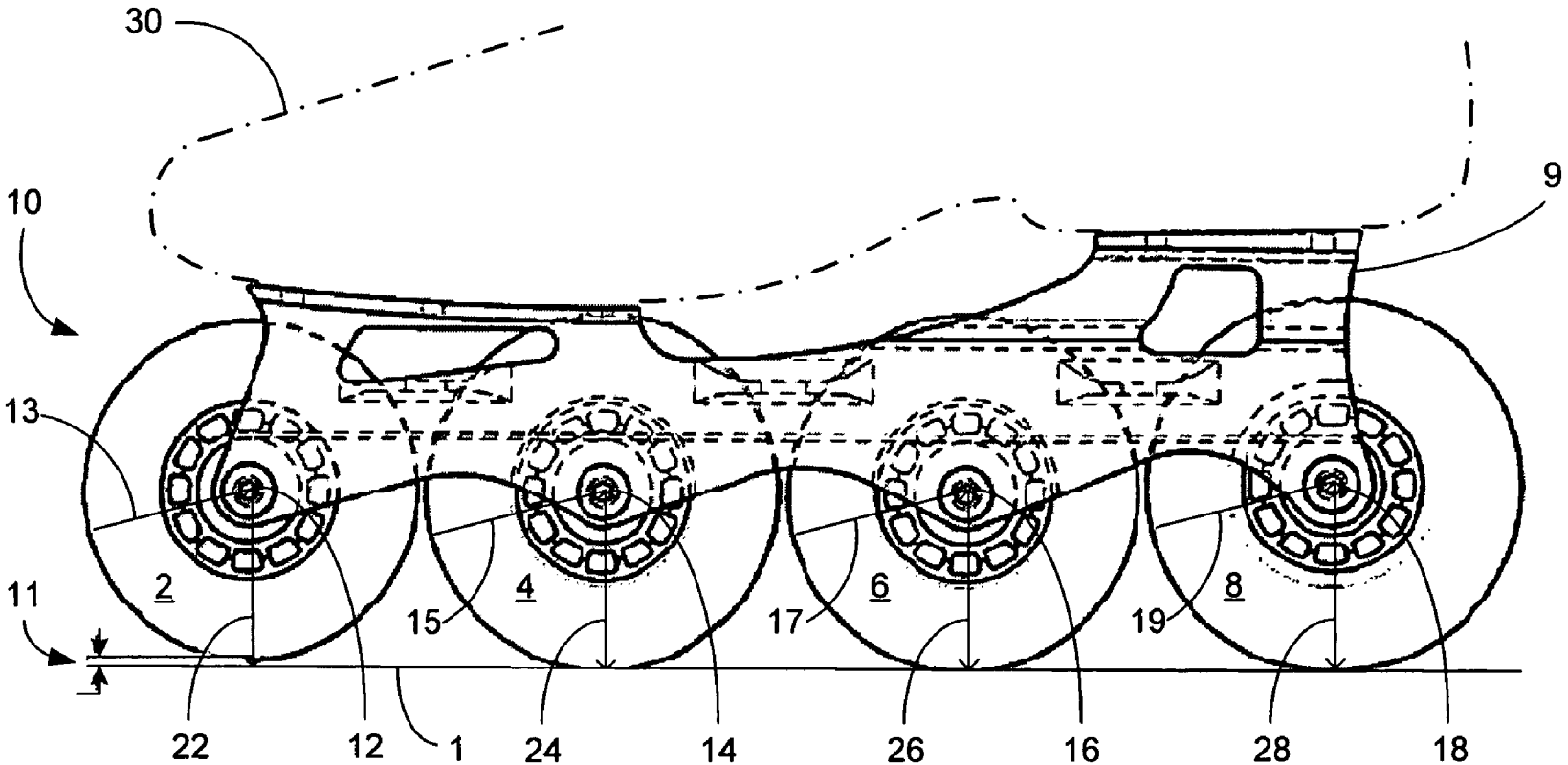
FIG. 1 is a partial sectional view of a roller assembly for an in-line roller skate in accordance with a particular embodiment of the present invention.

Referring to FIG. 1, there is shown a partial sectional view of a roller assembly 10 for an in-line roller skate in accordance with a particular embodiment of the present invention. The roller assembly 10, habilitated for receiving an associated footwear 30 such as a skating boot or shoe, comprises a roller frame 9 to which are pivotally fastened roller wheels 2, 4, 6, 8 about rotation axis 12, 14, 16, 18, respectively, through for example, a pin disposed in a slot. In the illustrated embodiment the roller assembly 10 has four roller wheels 2, 4, 6, 8 but it is to be understood that alternative embodiments may have a different number of roller wheels, for example a roller assembly for children in-line roller skates may have three roller wheels instead of four.

The roller wheels 2, 4, 6 and 8 are of radiuses 13, 15, 17 and 19, respectively. In the particular embodiment, the front roller wheel radius 13 has the smallest value, the rear roller wheel radius 19 has the biggest value and the two middle roller wheel radiuses 15, 17 have values in between that of the front roller wheel radius 13 and of the rear roller wheel radius 19. In accordance with a particular embodiment, the middle roller wheel radiuses 15, 17 are approximately equal. For example, the front roller wheel 2 may have a radius 13 of 36 mm, the middle roller wheels 4, 6 may have a radiuses 15, 17 of 38 mm and the rear roller wheel 8 may have a radius 19 of 40 mm. It should be noted that these values are described by way of example only, other combinations of roller wheel radiuses may be possible.

When the roller assembly 10 is in a resting position, the front roller wheel 2 and middle roller wheels 4, 6 have rotation axis 12, 14, 16, respectively, which are positioned generally equidistantly from surface 1, in other words distances 22, 24, 26 are approximately equal. However, the rear roller wheel's 8 rotation axis 18 is positioned at a greater distance from surface 1. More specifically distance 28 is greater than distances 22, 24 and 26. The difference between distance 28 and distances 22, 24 and 26 is proportional to the difference in radius between the middle roller wheels 4, 6 and the rear roller wheel 8. In the earlier example, where the middle roller wheels 4, 6 have radiuses 15, 17 of 38 mm and the rear roller wheel 8 a radius 19 of 40 mm, this translates in distance 28 being 2 mm greater than distances 22, 24 and 26. This insures that when the assembly 10 is in a resting position, that is the middle roller wheels 4, 6 and the rear roller wheel 8 are all resting on surface 1, the roller frame 9 remains parallel to surface 1.

The front roller wheel 2 having a radius 13 which is smaller than the radiuses 15, 17 of the middle roller wheels 4, 6, while having a distance 22 equal to distances 24 and 26, entails that, when in a resting position, the front roller wheel 2 is not in contact with surface 1. Thus, in a resting position, there is a gap 11 between the front roller wheel 2 edge and surface 1. The size of front gap 11 is equal to the difference between the front roller wheel 2 radius 13 and distance 22, which is the middle roller wheels 4, 6 radiuses 15, 17. To continue with the earlier example where the front roller wheel 2 has a radius 13 of 36 mm and the middle roller wheels 4, 6 have a radiuses 15, 17 of 38 mm, this translates in a front gap 11 of 2 mm.

In use, the variation in the sizes and positioning of the roller wheels 2, 4, 6 and 8, as described above, creates a rocker function that responds to the weight distribution of the user of the roller assembly 10. This rocker function has for effect to put the roller assembly 10 in either of two positions.

Figure 2:
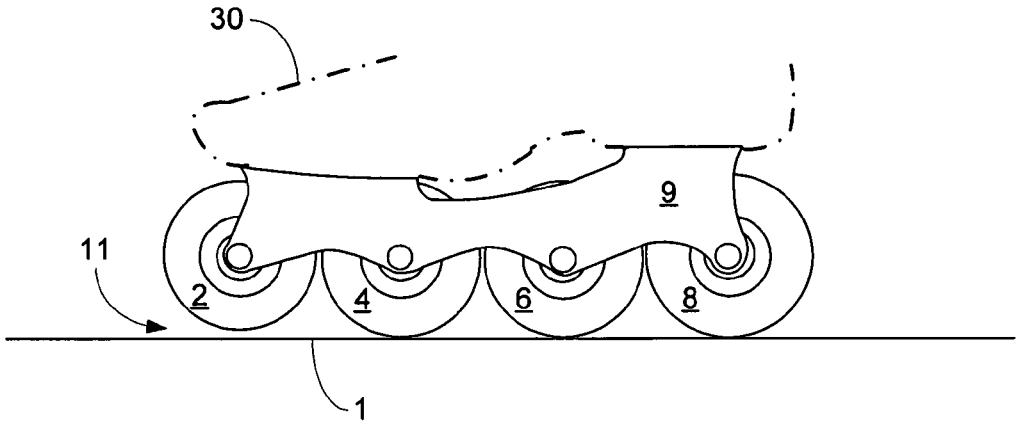
FIG. 2 is a side elevational view of the roller assembly of FIG. 1 in a first operative mode.

In a first position, such as shown in FIG. 2, the middle roller wheels 4, 6 and the rear roller wheel 8 are all in contact with surface 1 while front roller wheel 2 has gap 11 between its bottom edge and surface 1 such that only three of the four roller wheels are in contact with surface 1. This results in a shortening of the roller wheel base, which provides better maneuverability by allowing for a shorter turning radius while still providing similar stability as provided by four roller wheels since when the weight of the user is biased towards the rear, no weight is applied to the front roller wheel 2 and the rear roller wheel 8 is positioned beyond the heel of the user. Furthermore, the larger size of the rear roller wheel 8 allows the in-line roller skate to carry more speed when the user is turning an thus is in full acceleration. This first position is achieved for example, when the user of the roller assembly 10 is standing still, is in the process of turning or has his weight on his heels.

Figure 3:
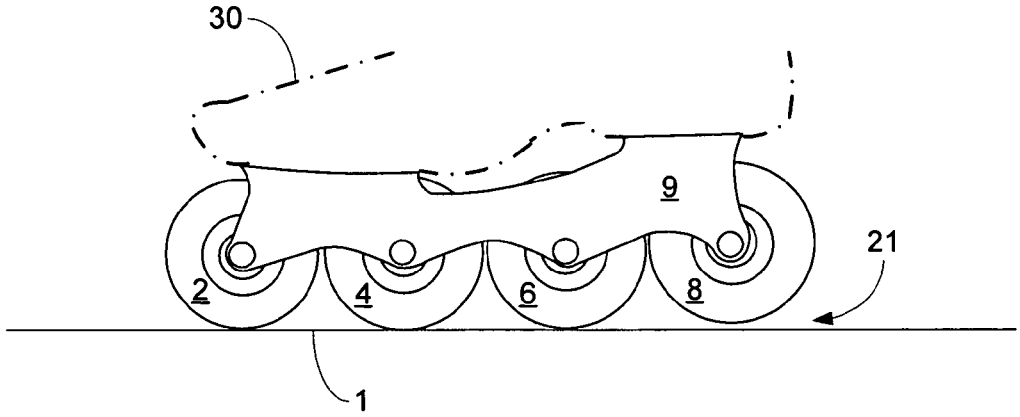
FIG. 3 is a side elevational view of the roller assembly of FIG. 1 in a second operative mode.

In a second position, such as shown in FIG. 3, the front roller wheel 2 and the middle roller wheels 4, 6 are all in contact with surface 1 while rear roller wheel 8 has gap 21 between its bottom edge and surface 1 such that only three of the four roller wheels are in contact with surface 1. As with the first position, this shortening of the roller wheel base provides better maneuverability while still providing similar stability as provided by four roller wheels since when the weight of the user is biased towards the front, no weight is applied to the rear roller wheel 8 and the front roller wheel 2 extends beyond the toes of the user. This second position is achieved for example, when the user of the roller assembly 10 is moving forward in a generally straight direction.

It should be noted that in the case where the roller assembly 10 comprises four roller wheels 2, 4, 6 and 8, the front and two middle roller wheels 2, 4 and 6 are simultaneously in contact with surface 1 when the user's weight is biased forward, even though the two middle roller wheels 4 and 6 are of similar sized. This is the result of the compressive nature of the material used in the fabrication of typical roller wheels, such as polyurethane, that allows the middle roller wheel 4 to slightly compress such that front roller wheel 2 and the middle roller wheels 4 and 6 are all simultaneously in contact with surface 1. As know in the art, the compression of typical roller wheels varies according to the durometer (hardness) of the material used. Thus, depending on the sizes of the front and two middle roller wheels 2, 4 and 6, an appropriate roller wheel material durometer may be selected.

Although the present invention has been described by way of particular embodiments and examples thereof, it should be noted that it will be apparent to persons skilled in the art that modifications may be applied to the present particular embodiment without departing from the scope of the present invention.

What is claimed is:

1. A roller assembly of an in-line roller skate, said roller assembly comprising:

a roller frame;

a front roller wheel, at least two middle roller wheels and a rear roller wheel pivotally and linearly received in the roller frame, each of the roller wheels being received in a predetermined, unchangeable position in the roller frame;

said front roller wheel having a first radius;

said at least two middle roller wheels having a same second radius greater than the first radius;

said rear roller wheel having a third radius greater than the second radius; and wherein the middle roller wheels and the rear roller wheel define a same plane tangent thereto, the center of the front roller wheel being located at a distance from the plane greater than the first radius, and the distance being equal to the second radius.

2. The roller assembly as defined in claim 1, wherein the front and middle roller wheels are engageable to a same planar surface while a gap is defined between the rear roller wheel and the planar surface.

3. The roller assembly as defined in claim 1, wherein the first radius is about 36 mm, the second radius is about 38 mm, and the third radius is about 40 mm.

* * * * *